US008534026B2

(12) United States Patent
Bauman et al.

(10) Patent No.: US 8,534,026 B2
(45) Date of Patent: Sep. 17, 2013

(54) TRUSS TOWER LEG REINFORCING SYSTEM

(75) Inventors: Kevin P. Bauman, Columbus, OH (US); Curtis J. Porr, Pickerington, OH (US)

(73) Assignee: AeroSolutions, LLC, Boulder, CO (US)

( * ) Notice: Subject to any disclaimer, the term of this patent is extended or adjusted under 35 U.S.C. 154(b) by 0 days.

(21) Appl. No.: 12/943,988

(22) Filed: Nov. 11, 2010

(65) Prior Publication Data

US 2011/0107709 A1 May 12, 2011

Related U.S. Application Data

(63) Continuation of application No. 11/871,288, filed on Oct. 12, 2007, now abandoned.

(60) Provisional application No. 60/829,451, filed on Oct. 13, 2006.

(51) Int. Cl.
*E04H 12/10* (2006.01)

(52) U.S. Cl.
USPC ..... 52/651.07; 52/651.01; 52/690; 52/223.4; 52/651.11; 52/652.1

(58) Field of Classification Search
USPC ..... 52/652.1, 651.02, 651.11, 651.04, 52/651.07, 849, 848, 836, 654.1, 690, 223.4
See application file for complete search history.

(56) References Cited

U.S. PATENT DOCUMENTS

| | | | | | |
|---|---|---|---|---|---|
| 835,280 | A * | 11/1906 | Haskell | 52/651.04 |
| 835,281 | A * | 11/1906 | Haskell | 52/651.04 |
| 1,658,535 | A * | 2/1928 | Neilson, Sr. | 52/223.4 |
| 1,693,107 | A * | 11/1928 | Campbell | 52/638 |
| 1,963,014 | A * | 6/1934 | Brown | 343/723 |
| 2,086,009 | A * | 7/1937 | Walker | 52/292 |
| 2,194,810 | A * | 3/1940 | Reiner | 52/695 |
| 2,387,120 | A * | 10/1945 | Cohen | 52/148 |
| 2,857,994 | A * | 10/1958 | Sheard | 52/40 |
| 3,360,288 | A * | 12/1967 | Holscher | 52/638 |
| 3,371,458 | A * | 3/1968 | Sturgill | 52/651.01 |
| 3,490,189 | A * | 1/1970 | Gostling | 52/655.1 |
| 3,670,471 | A * | 6/1972 | Smith | 52/638 |
| 4,216,636 | A * | 8/1980 | Cordell | 52/637 |
| 5,375,353 | A * | 12/1994 | Hulse | 40/217 |
| 5,787,673 | A * | 8/1998 | Noble | 52/848 |
| 5,832,688 | A * | 11/1998 | Crissey et al. | 52/651.01 |
| 5,894,703 | A * | 4/1999 | Lieb et al. | 52/651.01 |
| 6,108,996 | A * | 8/2000 | McGinnis | 52/651.02 |
| 6,935,025 | B1 * | 8/2005 | Watson et al. | 29/897.31 |
| 6,944,950 | B1 * | 9/2005 | Watson et al. | 29/897.31 |
| 7,253,786 | B1 | 8/2007 | Logozzo | |
| 7,581,360 | B2 * | 9/2009 | Olsen | 52/111 |
| 2002/0170261 | A1 | 11/2002 | Brunozzi et al. | |
| 2004/0020158 | A1 | 2/2004 | Kopshever | |
| 2004/0134155 | A1 * | 7/2004 | Lockwood et al. | 52/633 |
| 2008/0184653 | A1 | 8/2008 | Bauman et al. | |

* cited by examiner

*Primary Examiner* — Robert Canfield
*Assistant Examiner* — Babajide Demuren
(74) *Attorney, Agent, or Firm* — Lathrop & Gage LLP

(57) ABSTRACT

A reinforced triangular truss column having two vertical pipe reinforcing columns added to the three rods of the truss column is provided. Also provided is a method of reinforcing triangular truss columns comprising adding two vertical pipe reinforcing columns to a triangular truss column.

10 Claims, 2 Drawing Sheets

TRUSS TOWER LEG REINFORCING SYSTEM

CROSS-REFERENCE TO RELATED APPLICATIONS

This application is a continuation of U.S. application Ser. No. 11/871,288, filed Oct. 12, 2007, which claims the benefit of U.S. provisional application 60/829,451, filed Oct. 13, 2006, both of which are hereby incorporated by reference herein.

BACKGROUND OF THE INVENTION

Several communication tower manufacturers construct triangular self-supporting towers utilizing vertical columns constructed of triangular trusses. These tower columns (often referred to as the tower legs) resemble miniature triangular shop-welded tower sections. When additional loads are added to the tower, these truss legs may no longer be adequate to safely support the calculated tensile or compressive loads. To alleviate this overstress, the structural capacity of the truss columns must be enhanced. Field welding additional steel onto these truss legs is expensive and creates the potential for several problems. The heat of the welding operation destroys the galvanized coating on the existing steel members creating a corrosion problem. The heat of the welding operation may warp the existing steel and the sparks create a fire hazard. This invention was developed to address these problems.

SUMMARY OF THE INVENTION

Provided is a method of reinforcing a triangular truss column comprising: providing two generally vertical pipe reinforcing columns (16) each having a first pipe reinforcing plate attached at the top of the column (17) and a second pipe reinforcing plate at the bottom of the column (17); attaching the first pipe reinforcement plate to a first existing plate (13) of the triangular truss column; attaching the second pipe reinforcement plate to a second existing plate (13) of the triangular truss column; and connecting each vertical pipe reinforcing column to the truss column at one or more connection points along the pipe reinforcing column length. Also provided is a reinforced triangular truss column having two generally vertical pipe reinforcing columns attached to the outside of a portion of a triangular truss column.

The pipe reinforcing columns are connected to the truss column in the vertical direction using any suitable means as known in the art without undue experimentation. Some examples are described and shown herein. As one example, a metal strap or band (18) that spans one side of the triangular truss column is connected to two legs (12) of the triangular truss column (11). The strap or band may be connected to the legs of the triangular truss column using any suitable means, including bolts. The band or strap is any suitable width and thickness that provides the desired amount of support. It is not necessary, and is not preferred, that the metal strap be so wide that that it results in wind resistance or excess weight. In another embodiment, the pipe reinforcing columns are connected to the truss column using a band or strap which surrounds the truss column and the pipe reinforcing columns.

In one embodiment, the pipe reinforcing plates are attached to the existing plate of the triangular truss column using bolts (15). The pipe reinforcing column may be made from any suitable material, and do not need to be made from the same material. Each pipe reinforcing column may be hollow or solid.

As used herein, "generally vertical" or "generally horizontal" indicates the direction does not need to be exactly vertical or exactly horizontal with respect to a fixed point, but includes those situations where there is a small amount of variance, for example, ±10 degrees of variance. Other degrees of variance are included, for example ±5, ±15 and ±20 and all intermediate ranges and values therein.

DETAILED DESCRIPTION OF THE INVENTION

Truss Columns:

A single truss column is constructed of three individual solid round bars shop-welded at the top and bottom to a common plate. These three solid bars are connected to each other with horizontal and diagonal bracing (14) forming a three-dimensional triangular truss. It requires three truss columns to form a single triangular tower section. These tower sections are then stacked vertically and bolted together at the truss column plates.

Solution:

Presented here is a method to enhance the structural capacity of the existing truss columns that does not require field welding. Two vertical pipes are added to the three solid round rods of the truss column. These pipes have plates welded at the top and bottom. Several of the existing truss column splice bolts are removed. A new pipe column is inserted with new longer splice bolts inserted to connect the top and bottom plates of the new pipe column to the top and bottom plates of the truss column. There are also straps or other devices that connect the new pipe column to the truss column at intermediate intervals to prevent the pipe column from buckling away from the existing truss column. These straps are connected to the truss column with U-bolts (19) or other suitable connecting means, as known in the art. This invention is useful for any towers with truss-type legs (columns).

The result is that the truss column is no longer comprised of just three solid round rods or legs (12) but is now is comprised of the original three solid round rods plus two round pipes (16) which may be hollow.

Figure 1:
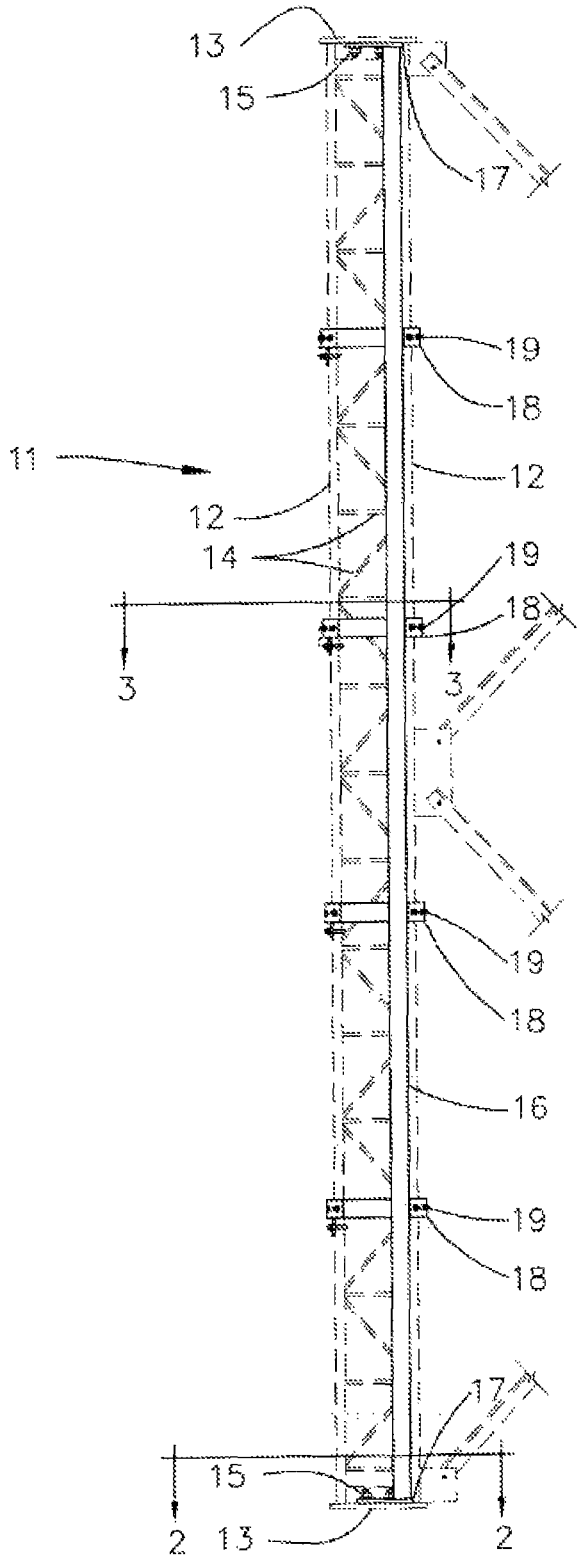
FIG. 1 illustrates a reinforced triangular truss column assembly in elevation view.
Figure 2:
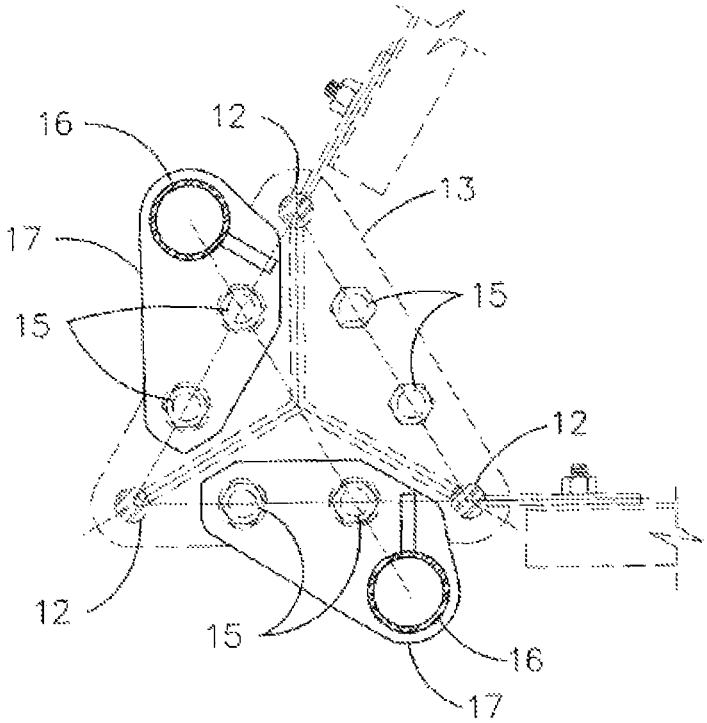
FIG. 2 is a horizontal cross section of the reinforced truss column assembly along line 2-2 of FIG. 1.
Figure 3:
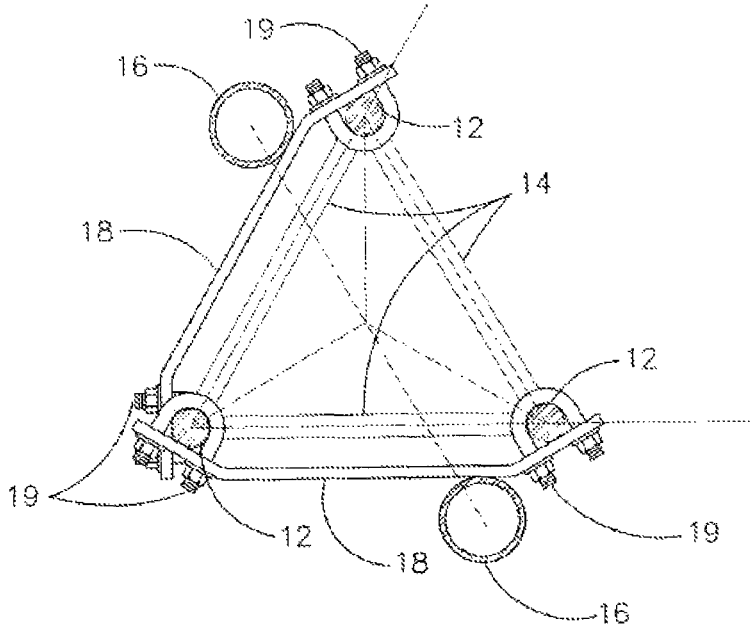
FIG. 3 is a horizontal cross section of the reinforced truss column assembly along line 3-3 of FIG. 1.

FIGS. 1-3 show embodiments of the invention. FIG. 1 shows a large-scale view. FIG. 2 shows the use of the invention at the existing tower leg splice plate(13), as described herein. FIG. 3 shows a connection band (18), as described herein.

All elements of the invention may be made from any suitable material, as known to one of ordinary skill in the art. The materials used may depend on the environment where the tower is used, as known in the art. The diameters of the vertical pipes (16) may vary, depending on the application. The vertical pipes (16) may be made from any suitable material, as known to one of ordinary skill in the art. The vertical pipes (16) may be metal, composite or polymer, for example. The vertical pipes(16) may be hollow or solid. The connecting bands(18) may be constructed from any suitable material, as known to one of ordinary skill in the art.

Although the invention is described with respect to triangular truss towers (11), it is well known in the art that the invention may be used with four-legged towers, as well, without undue experimentation, using two, three, or four vertical pipe reinforcing columns, using the information provided here and that information known in the art.

It should be understood that although the present description has been disclosed by specific embodiments and optional features, modification and variation of the concepts herein disclosed may be resorted to by those skilled in the art, and that such modifications and variations are considered to be within the scope of this invention.

We claim:

1. A reinforced triangular truss column assembly comprising:

a triangular truss column having three truss legs which attach together through leg splice plates, said triangular truss column having reinforcing columns along at least a portion of the outside of two sides of the triangular truss column, the top and bottom of each reinforcing column attached to the triangular truss column in the horizontal direction through a top pipe reinforcing plate and a bottom pipe reinforcing plate, and the reinforcing columns contacting a generally horizontal band, wherein the reinforcing columns are attached to the triangular truss column in the vertical direction with a generally horizontal band, wherein the reinforcing columns transfer the load to the truss column through the reinforcing plates.

2. The column assembly of claim 1, wherein the top and bottom pipe reinforcing plate are each bolted to a leg splice plate of the triangular truss column.

3. A reinforced truss column assembly comprising:

a triangular truss column having legs attached to vertical truss column plates;

a first horizontal band spanning a first side of the triangular truss column and connected to two legs of the triangular truss column;

a first vertical pipe reinforcing column having a first pipe reinforcing plate at the top of the pipe reinforcing column and a second pipe reinforcing plate at the bottom of the column, wherein the first pipe reinforcing plate is attached to a first vertical truss column plate and the second pipe reinforcing plate is attached to a second vertical truss column plate, and wherein the first vertical pipe reinforcing column is positioned adjacent to the first horizontal band along a side of the triangular truss column and contacts the first horizontal band on the outer surface;

a second horizontal band spanning a second side of the triangular truss column and connected to two legs of the triangular truss column;

a second vertical pipe reinforcing column having a first pipe reinforcing plate at the top of the pipe reinforcing column and a second pipe reinforcing plate at the bottom of the pipe reinforcing column, wherein the first pipe reinforcing plate is attached to a first vertical truss column plate and the second pipe reinforcing plate is attached to a second vertical truss column plate, and wherein the second vertical pipe reinforcing column is positioned adjacent to the second horizontal band along a side of the triangular truss column and contacts the first horizontal band on the outer surface, wherein each reinforcing column is attached to the triangular truss column with a metal band which spans a side of the triangular truss column and which band is connected to two truss legs using a bolting means.

4. The reinforced truss column assembly of claim 3, wherein the bolting means is a U-bolt bolted to the band and a leg of the triangular truss column.

5. The reinforced truss column assembly of claim 3, wherein the band is metal.

6. The reinforced truss column assembly of claim 3, wherein a pipe reinforcing column is hollow.

7. The reinforced truss column assembly of claim 3, wherein a pipe reinforcing column is solid.

8. The reinforced truss column assembly of claim 3, used in a method of reinforcing a triangular truss column.

9. The reinforced truss column assembly of claim 3 used to reinforce a communications tower.

10. A reinforced truss column assembly comprising:

a triangular truss column having legs attached to vertical truss column plates;

a first metal horizontal band spanning a first side of the triangular truss column and connected to two legs of the triangular truss column;

a first hollow or solid vertical pipe reinforcing column having a first pipe reinforcing plate at the top of the pipe reinforcing column and a second pipe reinforcing plate at the bottom of the pipe reinforcing column, wherein the first pipe reinforcing plate is attached to a first vertical truss column plate and the second pipe reinforcing plate is attached to a second vertical truss column plate, and wherein the first vertical pipe reinforcing column is positioned adjacent to the first horizontal band along an outer side of the triangular truss column;

a second metal horizontal band spanning a second side of the triangular truss column and connected to two legs of the triangular truss column;

a second hollow or solid vertical pipe reinforcing column having a first pipe reinforcing plate at the top of the pipe reinforcing column and a second pipe reinforcing plate at the bottom of the pipe reinforcing column, wherein the first pipe reinforcing plate is attached to a first vertical truss column plate and the second pipe reinforcing plate is attached to a second vertical truss column plate, and wherein the second vertical pipe reinforcing column is positioned adjacent to the second horizontal band along an outer side of the triangular truss column, wherein each reinforcing column is attached to the triangular truss column with a metal band which spans a side of the triangular truss column and which band is connected to two truss legs using a U-bolt bolted to the band and a leg of the triangular truss column, wherein the reinforcing columns transfer the load to the truss column through the reinforcing plates.

* * * * *